United States Patent [19]

Lee

[11] Patent Number: 4,924,735

[45] Date of Patent: May 15, 1990

[54] REVERSIBLE PIPE WRENCH

[76] Inventor: Clark J. Lee, 429-6 Chung Cheng Rd., Fu Liao Li., Tsao Tun Town, Nantou Hsien, Taiwan

[21] Appl. No.: 316,817

[22] Filed: Feb. 28, 1989

[51] Int. Cl.[5] ..... B25B 13/14

[52] U.S. Cl. ..... 81/133

[58] Field of Search ..... 81/58.3, 133

[56] References Cited

U.S. PATENT DOCUMENTS 1,334,674 3/1920 Pannitti ..... 81/58.3
4,561,330 12/1985 Chen ..... 81/133 X
4,597,315 7/1986 Chen ..... 81/133 X

FOREIGN PATENT DOCUMENTS 54064 10/1983 Taiwan .
57736 4/1984 Taiwan .

*Primary Examiner*—James G. Smith
*Attorney, Agent, or Firm*—Bacon & Thomas

[57] ABSTRACT

This invention is related to a reversible pipe wrench, specifically to a new and improved construction of a pipe wrench by which a continuous clamping operation may be performed by rotating in one direction and then ratcheting in the reverse direction without repeatedly removing the wrench from a work piece, whereby the clamping job is simplified and eased.

7 Claims, 3 Drawing Sheets

A - A

REVERSIBLE PIPE WRENCH

TECHNICAL FIELD OF THE INVENTION

This invention is related to a reversible pipe wrench, particularly to a reversible pipe wrench in which the effective rotational direction can be altered from one direction to the opposite direction by merely turning the pipe wrench, or vise versa.

BACKGROUND OF THE INVENTION

At present, there are varieties of pipe wrenches available in the market, but most of them have little innovative or progressive design that their function and effectiveness are almost identical. They cannot be continuously operated to achieve a clamping job by driving a pipe while rotating in one direction and obtaining a slipping or releasing condition while rotating in the reverse direction. Therefore, from the stand point of operation, these prior art pipe wrenches have many deficiencies such as:

1. When a conventional pipe wrench is operated to clamp a pipe, its jaws have to be released, removed and set back to the original angular position after turning an angular stroke. The same operation is done repeatedly until the pipe is fixed or completely disengaged.

2. If a pipe is operated in a limited space, it is difficult for the jaws of a conventional pipe wrench to be released and removed after turning an angular stroke. Subsequently, there is difficulty in clamping operation.

An object of this invention is to provide a reversible pipe wrench without the above mentioned drawbacks.

SUMMARY OF THE INVENTION

A reversible pipe wrench related to this invention comprises a movable jaw with an L shape in which the shorter portion is a jaw part and the longer portion is a sliding rod part, and both of them constitute an angle of 90° approximately, and said sliding rod part is provided a rack on the surface facing towards the direction of the jaw part and said jaw part is provided a plurality of zigzag teeth on the surface facing towards the direction of the sliding rod part;

a jaw housing in which a circular hollow seat is provided at the lower portion, a guide channel is provided across the top of said circular hollow seat to allow said sliding part being movably installed inside said guide channel with a portion of said rack protruding from the top of said circular hollow seat, and a jaw head having zigzag teeth is provided, which is opposite to the zigzag teeth face of said jaw part, to constitute an adjustable jaw opening;

a pinion having a plurality of gear teeth on its rim and a plurality of radially spaced unidirectional slant pawls on one side thereof, the pinion being rotatably mounted in said circular hollow seat with the slant pawls facing toward the opening of the circular seat, and with the gear teeth of the pinion being meshed with the rack;

a spring biased ball detent being mounted on the side wall of said circular hollow seat and pressed against the gear teeth on said pinion;

a handle having a circular hole at one end thereof, the circular hole containing a plurality of axially extending teeth on its side wall, the handle being disposed on the jaw housing with its circular hole in concentric alignment with the opening of the circular hollow seat of the jaw housing;

a ratchet wheel being non-rotatably mounted within the circular hole of the handle by a plurality of corresponding teeth provided on its rim being in meshed engagement with the teeth on the side wall of the circular hole, the ratchet wheel further having a plurality of radially unidirectional slant pawls corresponding to the slant pawls of the pinion, the set of slant pawls of both ratchet wheel and the pinion being disposed in meshed engagement with each other;

a spring means disposed within the circular hole of the handle for compressing and maintaining the ratchet wheel and the pinion in mesh engagement with each other;

a cover plate fixedly connected to the circular hole of the handle to enclose the spring means therein;

wherein the force exerted by the spring means to press said ratchet wheel against said pinion has a magnitude small enough to allow the friction force arising from slipping between said pinion and said ratchet wheel smaller than the force exerted by said spring biased ball detent on said pinion such that the ratchet wheel is sliding on the pinion instead of the pinion being driven by the ratchet wheel when the reversible pipe wrench is rotated in ratcheting direction.

According to the above description of all member parts of this reversible pipe wrench, it can be understood that the pinion is driven by the ratchet wheel due to the unidirectional slant pawls thereof being in meshed engagement as the handle is rotated in active direction, and then the movable jaw is driven to approach the jaw housing and to perform the clamping operation because of the rack of the sliding rod part being in meshed engagement with the gear teeth of the pinion. When said reversible pipe wrench is rotated in the opposite direction, because the engaged unidirectional slant pawls between the pinion and the ratchet wheel are in sliding direction and together with the spring biased ball detent prevents the pinion from being driven by the ratchet wheel, the handle of the reversible pipe wrench is directly returned to the original angular position without reversing the clamping operation.

According to one of the preferred embodiments of this invention, the reversible pipe wrench mentioned above may be constructed with an additional ratchet wheel to be engaged with the pinion, which is symmetric to the original one on the opposite side of a central dividing line along the longitudinal direction of the handle, to improve the strength of the reversible pipe wrench.

DETAILED DESCRIPTION OF THE PREFERRED EMBODIMENT

Figure 1:
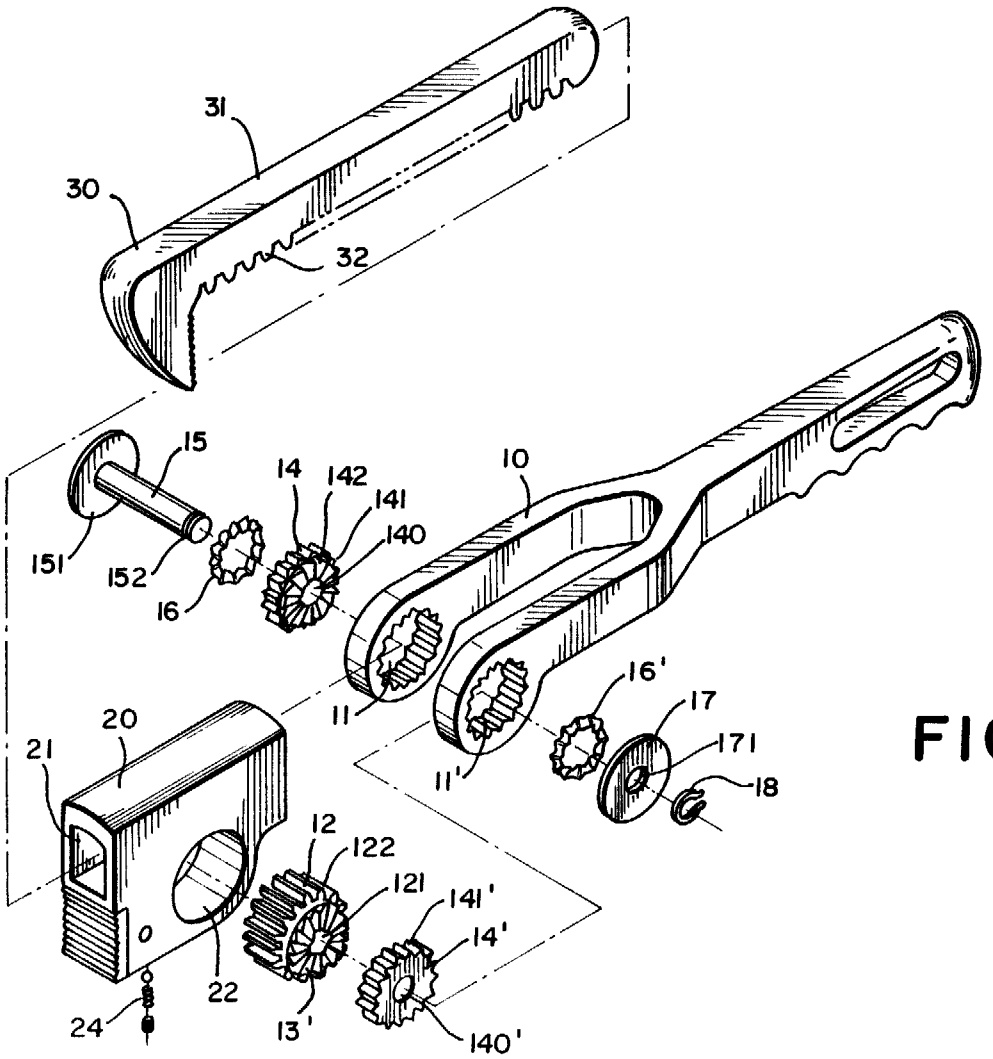
FIG. 1 shows an exploded perspective view of a preferred embodiment of a reversible pipe wrench according to this invention.
Figure 2:
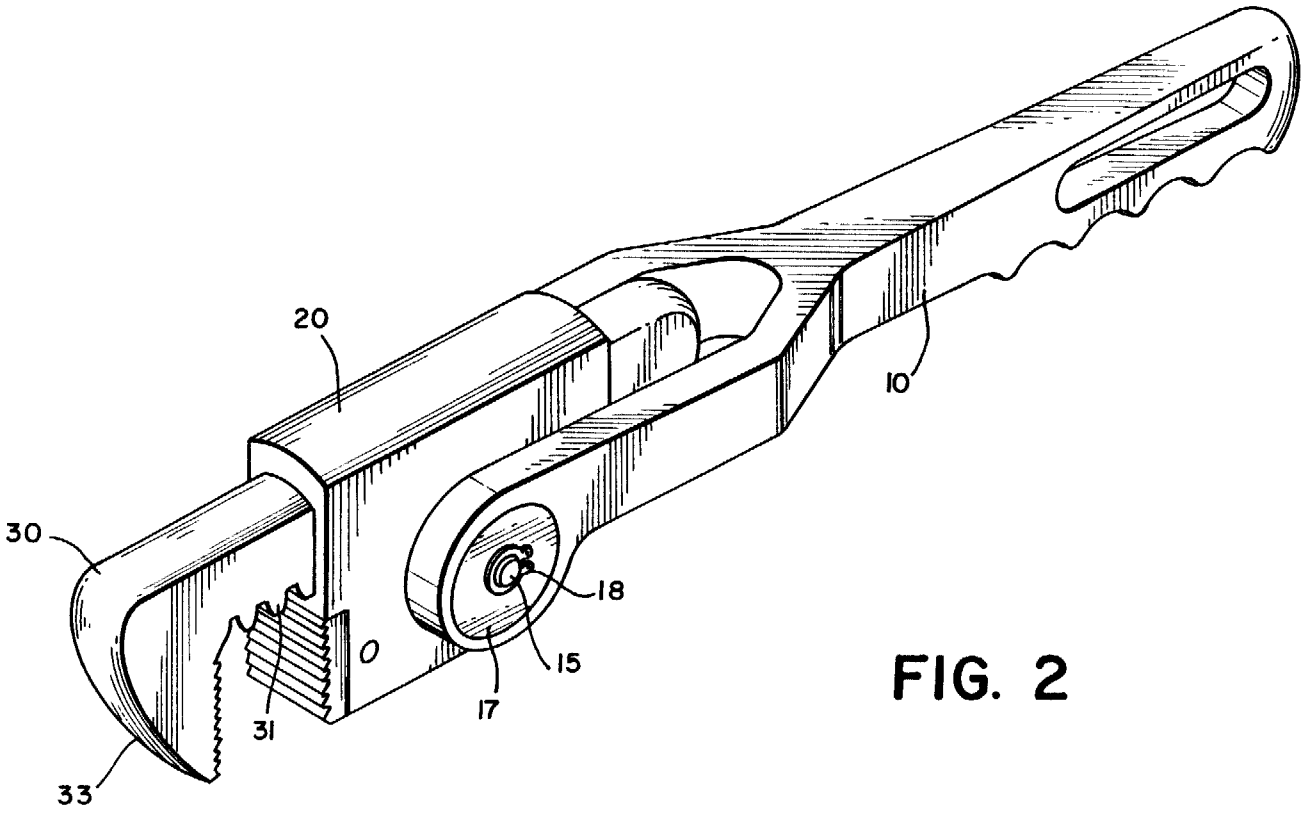
FIG. 2 shows an assembled perspective view of FIG. 1.

Referring to FIGS. 1 and 2, the reversible pipe wrench basically contains a movable jaw 30, a jaw housing 20, and a handle 10 having a fork structure at one end thereof. A circular hole 22 is provided at the lower portion of the jaw housing 20, and a pinion 12 having gear teeth 122 on its rim, radially unidirectional slant pawls 13, 13' on both sides of the pinion, (pawl 13 shown in FIG. 4) and a central axial hole 121 is mounted inside the circular hole 22. A guide channel 21 is provided across the top of the circular hole 22 to allow a sliding rod part 31 of the movable jaw 30 with a rack 32 on the lower inner surface being movably installed inside said guide channel 21. Furthermore, said rack 32 meshes with the gear teeth 122 of the pinion 12. Each arm of the fork structure contains a similar circular hole 11, 11' respectively at its front end, the hole 11, 11' are facing each other. Both hole 11 and 11' have similar axially extending teeth on their side walls. The jaw housing 20 is disposed between the arms of the fork structure of the handle 10 with the hole 22, and the holes 11, 11' thereof in concentric alignment with each other.

A pair of ratchet wheels 14, 14' are non-rotatably mounted within the circular holes 11, 11' by teeth 141, 141' provided on their rims being in meshed engagement with the teeth the side walls of the hole 11 and 11', respectively.

Figure 4:
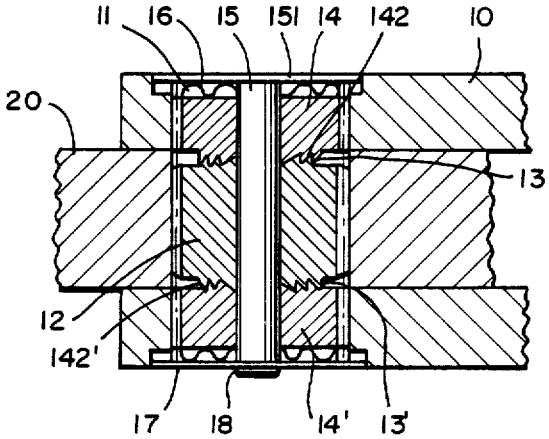
FIG. 4 shows a sectional view along line A—A in FIG. 3.

As shown in FIG. 4, the ratchet wheel 14 further contains radially unidirectional slant pawls 142 on its inner side corresponding to the slant pawls 13 of the pinion 12, and the set of slant pawls 142 and 13 of both the ratchet wheel 14 and the pinion 12 are being disposed in meshed engagement with each other. On the other side of the ratchet wheel 14, an undulated spring washer 16 is provided for compressing and maintaining the ratchet wheel 14 and the pinion 12 in meshed engagement with each other. Symmetrically to the ratchet wheel 14 on the opposite side of a central dividing line along the longitudinal direction of the handle 10, the ratchet wheel 14' and the pinion 12 are being maintained in meshed engagement with each other. A spindle 15 having a radial flange 151 at one of its end is provided to pass through holes 140, 140' located at the central portion of the ratchet wheels 14, 14', respectively, and the central axial hole 121 of the pinion 12 with the radial flange 151 covering the hole 11 and the other end of the spindle 15 protruding from the hole 11' of the handle 10. A cover plate 17 having a diameter slightly larger than the diameter of the hole 11' and a central axial hole 171 which has a diameter equal to the diameter of the spindle 15 also provided to cover the hole 11' of the handle 10 with the spindle 15 protruding from the hole 171. The spindle 15 is retained inside the holes 11, 121, 11', and 171 by clamping a C-shaped ring 18 onto a groove 152 located at the protruding end portion of the spindle 15.

Figure 3:
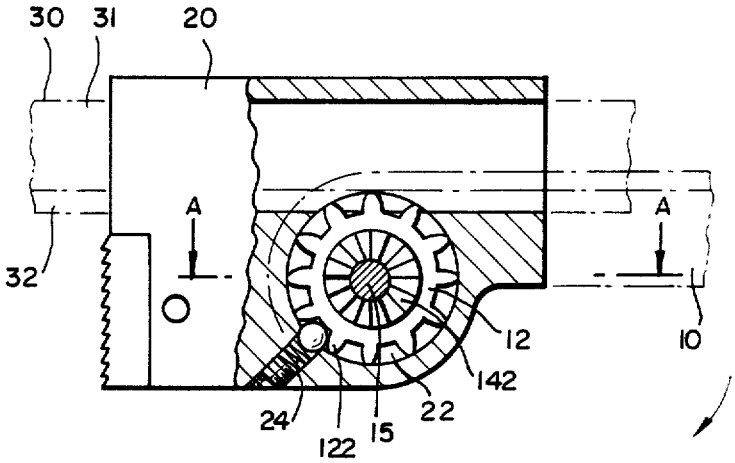
FIG. 3 shows a longitudinal fragmentary sectional view of FIG. 2.

Referring to FIGS. 1 and 3, a spring biased ball detent 24 is mounted on the side wall of the circular hole 22 of the jaw housing 20, and being pressed against the gear teeth 122 of the pinion 12, such that the pinion 12 is held by the ball detent 24 and the ratchet wheels 14, 14' are sliding on the pinion 12 as the reversible pipe wrench is rotated in ratcheting direction. The ratcheting direction is decided by the profile of the unidirectional slant pawls of the pinion and the ratchet wheels. As shown in FIGS. 1 and 4, the ratcheting direction is counterclockwise in this embodiment. Additionally, each of the spring washers 16, 16' must have an elasticity which allows the spring washer to be compressed to an extent equal to or greater than the sum of the height of the unidirectional slant pawl tooth of the pinion 12 and that of the ratchet wheel 14 or 14', and allows the friction force existing between the pinion 12 and the ratchet wheel being smaller than that between the ball detent 24 and the pinion 12.

Both holes 11, 11' which are located at the front end of the handle 10 are provided a recess at the outer end edge respectively, for accommodating the flange 151 located at the end portion of the spindle 15 and the cover plate 17. Each recess has a depth available for users to press flange 151 and cover plate 17 inwardly to urge against both spring washers 16, 16' simultaneously.

As FIGS. 3 and 4 show, when a work piece is going to be clamped, simply rotate handle 10 in the clockwise direction (the direction shown in FIG. 3) and said two ratchet wheels 14, 14' would rotate synchronuously. And also, the pinion 12 is driven simultaneously because said two sets of unidirectional slant pawls 142, 142' on these two ratchet wheels 14, 14' are pressed to mesh with the slant pawls 13, 13' of said pinion 12, respectively. Finally because of the meshed engagement of said pinion 12 with the rack 32 of the sliding rod part 31, said movable jaw 30 will in turn move toward said handle 10 to perform clamping operation. Furthermore, after finishing an angular stroke of clamping work, the handle 10 is rotated in the reverse (counterclockwise) direction and ready for the next clamping job with the ratchet wheels 14, 14' sliding on the pinion 12, where the pinion 12 is held by the ball detent 24. Thus the position of the movable jaw 30 remains unchanged.

If the pipe wrench is going to be loosened off the work piece, just press the flange 151 and the cover plate 17 simultaneously. At this moment, both the spring washers 16, 16' are in the compressed condition. Therefore, once the handle 10 is rotated in the reverse direction, the pinion 12 and both of ratchet wheels 14, 14' will be in the engaged condition, and the sliding rod part 31 will be driven by the pinion 12 to release the work piece.

The above detailed description for the preferred embodiment of this invention illustrates that the reversible pipe wrench of this invention has a special clamping feature which is simply rotating the handle in one direction to provide a clamping operation and ratcheting in the reverse direction.

Again, the advantages of this invention will be stated the following:

(1) a work piece may be kept contact and clamped by the reversible pipe wrench of this invention, and said pipe wrench is not necessary to be removed from the work piece after rotating a certain angular stroke as the traditional pipe wrench does. Therefore, the clamping operation is quick and convenient;

(2) due to its ability for continuous clamping operations the reversible pipe wrench of this invention particularly fits to work in an environment with very limited space without any difficulty.

I claim:

1. A pipe wrench comprising:

(a) a jaw housing defining a generally longitudinally extending opening, a generally laterally extending opening and a fixed jaw face;

(b) a movable jaw member slidable received in the generally longitudinally extending opening, the jaw member having a movable jaw face portion and a sliding rod portion;

(c) a plurality of gear teeth formed on the sliding rod portion;

(d) a pinion gear member rotatably received in the generally laterally extending opening such that the pinion gears engage the gear teeth on the sliding rod portion;

(e) a handle member defining at least one laterally facing opening in alignment with the generally laterally extending opening in the jaw housing;

(f) pivot attaching means to pivotally attach the handle member to the jaw housing so as to pivot about a generally laterally extending pivot axis;

(g) ratchet means interconnecting the handle member and the pinion gear such that, when the handle member is pivoted in a first direction about the pivot axis the ratchet means rotates the pinion gear to move the movable jaw member so as to move the movable jaw face toward the fixed jaw face, and when the handle member is pivoted in an opposite direction about the pivot axis, the ratchet means disengages such that no movement of the pinion gear or movable jaw member takes place; and (h) means to selectively prevent the disengagement of the ratchet means when the handle member is pivoted in the opposite direction such that the pinion gear is rotated to move the moveable jaw member and to move the movable jaw face away from the fixed jaw face.

2. The pipe wrench according to claim 1 wherein the ratchet means comprises:

(a) a first set of laterally facing ratchet pawls on the pinion gear member;

(b) a ratchet wheel non-rotatably mounted on the handle member;

(c) a second set of laterally facing ratchet pawls on the ratchet wheel;

(d) biasing means to bias the second set of ratchet pawls into engagement with the first set of ratchet pawls.

3. The pipe wrench according to claim 2 further comprising:

(a) a first set of teeth formed on the laterally facing opening in the handle member; and, (b) a second set of teeth formed on the periphery of the ratchet wheel engaging the first set of teeth to prevent relative rotation between the ratchet wheel and the handle member.

4. The pipe wrench according to claim 3 wherein the biasing means comprises:

(a) a cover plate attached to the pivot attaching means; and, (b) spring means interposed between the cover plate and the ratchet wheel.

5. The pipe wrench according to claim 4 wherein the spring means is compressible a distance greater than the lateral dimensions of the first and second ratchet pawls to facilitate their disengagement when the handle member is pivoted in the opposite direction.

6. The pipe wrench according to claim 5 wherein the means to prevent the disengagement of the ratchet means comprises means to slidably mount the cover plate on the pivot attaching means such that the cover plate may be manually moved in a lateral direction toward the ratchet wheel thereby increasing the spring biasing force exerted thereon so as to prevent disengagement of the first and second sets of ratchet pawls when the handle member is rotated in the opposite direction.

7. The pipe wrench according to claim 6 wherein the spring biasing means comprises an undulating spring washer.

* * * * *